US005166653A

United States Patent [19]

Bosch et al.

[11] Patent Number: 5,166,653

[45] Date of Patent: Nov. 24, 1992

[54] TRIP DEVICE FOR AN ELECTRIC SWITCH

[75] Inventors: Hendrik A. Bosch, Hengelo; Soedjimat F. Darmohoetomo, Halle, both of Netherlands

[73] Assignee: Holec Systemen & Componenten B.V., Hengelo, Netherlands

[21] Appl. No.: 604,647

[22] Filed: Oct. 29, 1990

[30] Foreign Application Priority Data

Oct. 31, 1989 [NL] Netherlands ..... 8902691

[51] Int. Cl.[5] ..... H01F 3/12; H01F 7/08; H01H 9/00

[52] U.S. Cl. ..... 335/236; 335/176

[58] Field of Search ..... 335/236, 237, 234, 35, 335/172, 174, 175, 176, 253, 254, 177, 179, 180

[56] References Cited

U.S. PATENT DOCUMENTS

| | | | |
|---|---|---|---|
| 3,753,178 | 8/1973 | Kato | 335/135 |
| 3,755,766 | 8/1973 | Read, Jr. | 335/229 |
| 3,797,773 | 3/1974 | Berry | 335/236 |
| 4,072,918 | 2/1978 | Read, Jr. | 335/236 |
| 5,010,310 | 4/1991 | Frielinghaus | 335/243 |

*Primary Examiner*—Leo P. Picard
*Assistant Examiner*—Ramon M. Barrera
*Attorney, Agent, or Firm*—Watson, Cole, Grindle & Watson

[57] ABSTRACT

An improved trip device for an electric switch comprises a yoke, a permanent magnet immovably positioned with respect to the yoke and a movably supported armature forming a first magnetic circuit, in which the armature is able to assume a first position under the influence of the magnetic field of the permanent magnet. A magnet winding and spring are provided for causing the armature to assume a second position in response to the magnetic field generated by an electric current, flowing during operation in the magnet winding. For adjusting the threshold value at which the armature is moved to its second position, a second magnetic circuit in the form of shunt interacting with the yoke and the permanent magnet is provided. The magnetically effective surface area of the shunt is smaller in the vicinity of the section thereof which interacts with the yoke than in the vicinity of the section which interacts with the permanent magnet.

13 Claims, 3 Drawing Sheets

TRIP DEVICE FOR AN ELECTRIC SWITCH

BACKGROUND OF THE INVENTION

The invention relates to a trip device for an electric switch, comprising a yoke of magnetizable material, a permanent magnet immovably positioned with respect to the yoke and a movably supported armature of magnetizable material, mutually arranged in a manner such that the armature, the permanent magnet and the yoke form a first magnetic circuit, the armature being able to assume a first position under the influence of the magnetic field of the permanent magnet, further comprising at least one magnet winding and spring means for causing the armature to assume a second position in response to the magnetic field generated by an electric current, flowing during operation in the at least one magnet winding, if a pre-set threshold value is exceeded, a second magnetic circuit being provided for adjusting the threshold value in the form of shunt means of magnetizable material interacting with the yoke and the permanent magnet in order to influence the magnetic field in the first magnetic circuit by shunting.

A trip device of this type which is suitable for activating the switch mechanism of switches by electrical means is known per se from U.S. Pat. No. 3,693,122.

In the nonactivated operating state, the armature is held in the first position against the force action of the spring means under the influence of the permanent magnet, the switch to be actuated by the trip device can be in the conducting state, for example. By energizing the at least one magnet winding with an electric current the magnetic field of the permanent magnet acting on the armature can be influenced in a manner such that the armature is moved to its second position under the influence of the spring means in order to bring the respective switch into the nonconducting state, for example. In practice, this may be the case if earth fault currents occur or if a current to be monitored in an electrical installation exceeds a predetermined maximum value.

To detect these fault situations, separate means, for example an electronic circuit designed for this purpose, may be employed and with the aid thereof the at least one magnet winding can be energized for causing the armature to assume the second position. A trip device equipped with such an electronic circuit is, for example, disclosed in U.S. Pat. No. 4,731,692.

If the use of a separate electronic circuit and/or energizing circuit for the at least one magnet winding is undesirable from, for example, a cost engineering point of view or because of a greater chance of malfunctions, a current to be monitored or a derived value thereof can, of course, also be passed directly through the at least one magnet winding of the trip device.

The threshold value above which the trip device responds is influenced by mechanical tolerances in the spring means and the dimensions of, for example, the yoke, the supporting means for the armature and the like, as a result of which undesirable air gaps and magnetic leakage fields may be produced in the first magnetic circuit, and by tolerances in the magnetic field strength of the permanent magnet.

For setting the threshold value, the magnetic shunt means can advantageously be used in order to influence the magnetic field strength of the permanent magnet acting on the armature by magnetic shunting.

However, in addition to a desired influencing of the magnetic field in the first magnetic circuit, said shunt means also cause undesirable leakage fields which may disadvantageously influence the intended accuracy of the set threshold value of the trip device itself. The setting of adjacently mounted trip devices, for example, in a three-phase installation, or other electrical devices sensitive to magnetic fields may also be influenced.

U.S. Pat. No. 3,693,122, for example, discloses an embodiment of a trip device in which the shunt means have essentially the form of a flat plate, which shunt plate is positioned with its one surface partially opposite a pole face of the permanent magnet and with its other surface partially opposite the armature, while another section of the shunt plate is arranged at a distance from, and at an angle to, a part of the yoke.

The rectangular form, essentially used, of the known shunt plate is undesirable as regards the occurrence of magnetic leakage fields to the environment of the trip device. In particular, this happens when relatively flat permanent magnets are used because a relatively large magnetic leakage field is then produced between the shunt plate and the part of the yoke on which the permanent magnet is mounted, due to the relatively large surface area of said shunt plate.

The use of shielding means against the undesirable leakage fields, for example, in the form of a metal housing or metal screens, will in practice often entail an increase in the total cost of the trip device or a switch provided with such a trip device. In practice, it is moreover not always possible to use such screening means, for example, as a consequence of the construction of the trip device, but also in situations in which no metallic housings are permitted for safety considerations.

SUMMARY OF THE INVENTION

An object of the present invention is to provide an improved trip device using magnetic shunt means for setting the threshold value accurately.

According to the present invention, the undesirable magnetic leakage fields caused by the shunt means in the trip device of the type mentioned above are reduced by the fact that the magnetically effective surface area of the shunt means is made smaller in the vicinity of the section thereof which interacts with the yoke than in the vicinity of the section which interacts with the permanent magnet.

It has in fact been found that the section of the shunt means extending outside the pole face of the permanent magnet makes the greatest contribution to the undesirable magnetic leakage fields. By reducing the magnetically effective surface area of the section of the shunt means, on the one hand, a greater physical distance from those parts of the yoke and the environment with which no magnetic interaction is intended is achieved and, as a consequence of the greater magnetic resistance thereby achieved, a lower magnetic leakage flux is achieved between the parts and the shunt means. On the other hand, a certain degree of field control can be achieved between the shunt means and the parts of the yoke which belong to the second magnetic circuit.

In an embodiment of the invention, the yoke comprises at least two legs at an angle to each other. The permanent magnet is situated in the vicinity of the free end of one leg thereof. The shunt means has essentially the form of a flat shunt plate. The section of the shunt plate interacting with the permanent magnet is positioned with its one surface partially opposite a pole face of the permanent magnet and with its other surface partially opposite the armature. The section of the shunt plate interacting with the yoke is arranged at a distance from, and at an angle to, a further leg of the yoke. The undesirable leakage field is reduced in that the shunt plate is dimensioned such that the section situated opposite the pole face of the permanent magnet extends as far as possible inside the circumferential boundary of the respective pole face, whereas the section of the shunt plate interacting with the yoke extending in the direction of the said further leg has a shape which decreases in surface area in the direction of the respective leg.

In this embodiment of the invention, the section of the shunt plate situated opposite the pole face of the permanent magnet will make virtually no contribution to the leakage flux. The section of the shunt plate extending outside the pole face of the permanent magnet makes a smaller contribution to the leakage flux, as a result of its decreasing surface area, than the corresponding section of the known rectangular shunt plate. The shape decreasing in surface area in the direction of the respective leg of the yoke also brings about a certain degree of magnetic field control in the direction of the leg.

In the preferred embodiment of the trip device according to the invention, the permanent magnet is cylindrical in shape with disc-shaped pole faces. The section of the shunt plate situated opposite the respective pole face of the permanent magnet has a disc-shaped surface, the diameter of which is equal to or less than the diameter of the respective pole face. The other section of the shunt plate extending in the direction of the further leg of the yoke is of symmetrically tapered and converging shape.

It has been found that, if the surface of the section of the shunt plate according to the invention extending in the direction of the further leg of the yoke is less than half the surface area of the section of the shunt plate situated opposite the respective pole face of the permanent magnet, as optimum a shunt action as possible is achieved, with acceptable, low leakage fields.

Reducing the magnetically effective surface area of the shunt plate furthermore has the additional advantage that, in trip devices, for example, in which the current to be monitored or a portion thereof flows directly through the at least one magnet winding, demagnetization of the permanent magnet as a consequence of a high current peak or the like is virtually eliminated. To be specific, the relatively small amount of magnetizable material of the shunt plate will, in that case, rapidly become saturated, as a result of which shunting with low magnetic resistance is produced.

The shunt plate can be either of fixed or adjustable design, but may also form part of the yoke.

In order to accurately set the threshold value of the magnetic field in the first magnetic circuit, i.e. the value of the current through the at least one magnet winding at which tripping occurs, for example, with an immovably positioned shunt plate, it is, moreover, of importance that no additional magnetic resistance is added to the circuits in the form of air gaps and the like. In addition to influencing the total magnetic field in the respective magnetic circuit and consequently the force which is exerted on the armature, leakage fields which may undesirably influence the operation and accuracy of the trip device and any adjacently situated other devices may be produced at positions with increased magnetic resistance.

In the trip device known from U.S. Pat. No. 3,693,122, the problem arises that the armature or the tubular supporting body thereof, and the passage opening in one leg of the yoke, have to be accurately matched to one another as regards dimensions and have to be accurately aligned with one another after assembly in order to prevent undesirable air gaps and the like which influence an accurate setting of the threshold value disadvantageously.

A solution of this problem aimed at optimizing the accurate setting of the threshold value in accordance with the object of the invention is provided in a further embodiment of the invention wherein the armature is of elongated shape and the yoke comprises at least two legs situated as far as possible in parallel and at a distance from each other, between which legs a tubular supporting body extends in order to movably support the armature. At least one of the legs is provided with a passage opening through which the armature can be moved. A bush of magnetizable material is mounted between the respective leg at the position of the passage opening and the end of the supporting body connecting thereto.

The bush forms an extension piece of the opening of the tubular supporting body, the internal dimensions of the bush being accurately matched to the thickness of the armature, one end of which is able to extend outside the yoke via said bush and the passage opening. The bush connects directly to the respective leg of the yoke around the passage opening.

Because the bush connects accurately to both the armature and the respective leg of the yoke, the path of the first magnetic circuit will run via said bush and said leg of the yoke. This means that the passage opening in the yoke can be more amply dimensioned than the thickness of the armature, which is advantageous both from a production engineering and a cost engineering point of view, especially when a laminated yoke is used. However, the direct connection of the bush to the respective leg of the yoke requires a precise dimensioning and assembly of the yoke and the supporting body, in particular, in the case of yokes constructed as a single entity.

In order to reduce effectively the occurrence of an air gap between the bush and the respective leg of the armature in the event of, for example, undesirable dimensional deviations, in a further embodiment of the invention the bush extends into the passage opening.

Any magnetic leakage field between the armature and the passage opening in the yoke is effectively reduced thereby. In addition, this embodiment of the invention also offers the possibility of greater tolerances in the dimensioning of the yoke and the supporting body without disadvantageous effect on the intended accuracy of the threshold value. It will be clear that this is advantageous from a production engineering point of view.

In an embodiment, which is advantageous from an assembly point of view, of the invention with which the occurrence of an air gap between the bush and the respective leg of the yoke can also be effectively prevented, the respective leg with the passage opening is constructed as a separate element to be attached to the yoke. This embodiment is suitable, in particular, in combination with a bush which can extend into the passage opening. In addition to preventing unintentional magnetic resistance in the magnetic circuit, the bush can also be used for adding a magnetic resistance in a controlled way to the magnetic circuit in order to influence the threshold value. For this purpose, in an embodiment of the trip device according to the invention the bush is manufactured from magnetizable material having magnetizable properties differing from the material of the armature and the yoke.

In addition to the abovementioned measures, in an embodiment of the trip device according to the invention, the armature is of elongated shape and is situated with one end opposite the said other surface of the section of the shunt plate situated opposite the respective pole face of the permanent magnet. The tolerance in the set threshold value is reduced still further in that a convex elevation having a larger radius compared with the diameter of the armature is provided in the other surface of the shunt plate at the position where the armature encounters the shunt plate.

This measure effectively reduces the influence of any misalignment of the armature with respect to the shunt plate, for example, as a consequence of mechanical tolerances and/or a defective alignment. Even with a slight misalignment a relatively large magnetic contact surface is nevertheless achieved between the armature and the shunt plate, it being possible for the armature to be flat in shape at the end. In contrast to the practice of rounding off the armature at the respective end, providing the shunt plate with an elevation, for example, by pressing, is, according to the invention, easier and cheaper from a production engineering point of view.

The invention also relates to an electrical switch having a housing and at least one contact pair, a spring system and actuating means for bringing the at least one contact pair into one or another position under the influence of the action of the spring system, which actuating means comprise a trip device according to one or more of the preceding embodiments.

Embodiments of the trip device according to the invention are described below with reference to the drawings.

DETAILED DESCRIPTION OF THE EMBODIMENTS

Figure 1:
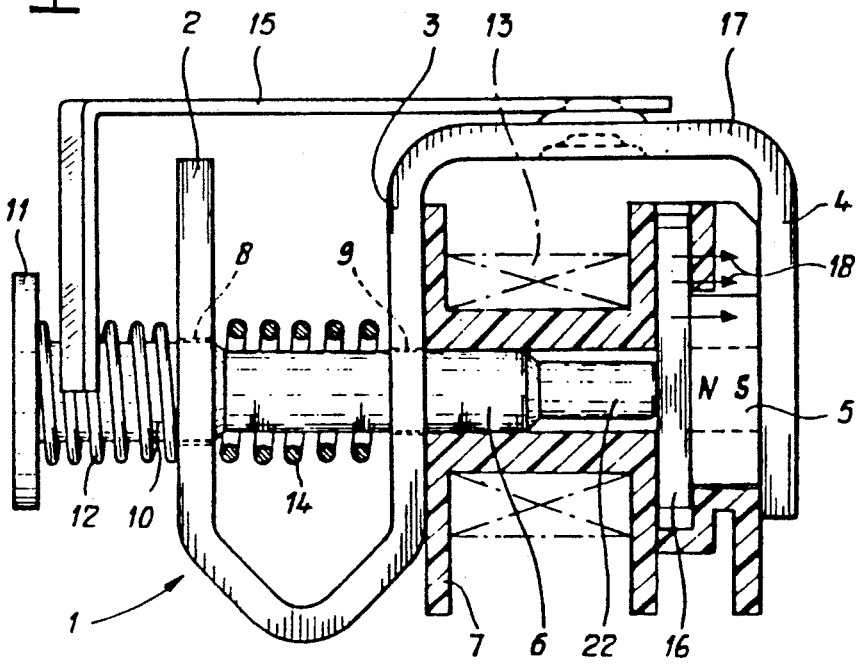
Fig-1 (Prior Art)
FIG. 1 shows diagrammatically and partially in cross section an embodiment of a trip device for use in an electrical switch such as is described in the U.S. patent application Ser. No. 460,516 assigned to the assignee of the present application.

Elements with a corresponding function and/or construction are indicated below by the same reference numerals.

FIG. 1 shows a side elevation, reproduced partially in cross section, of an embodiment of a trip device for use in electrical switches which has been proposed earlier by the U.S. patent application Ser. No. 460,516.

The trip device shown in FIG. 1 comprises an approximately S-shaped yoke 1 of magnetizable material such as soft iron, steel and the like with legs 2, 3 and 4 situated in parallel. Arranged between the two legs 3, 4 is a permanent magnet 5 made of, for example, ferroxdure. The North and South poles of the permanent magnet 5 are respectively indicated by N and S. Arranged in line with the magnetic axis of the permanent magnet 5 is a rod-shaped elongated armature 6 made of magnetizable material such as, for example, soft iron or steel and movably supported with the aid of a tubular supporting body 7. The legs 2, 3 of the yoke 1, which adjoin each other, are provided with passage openings 8 and 9 respectively through which the armature 6 can be moved.

The supporting body 7 may be produced from plastic. The legs 3, 4 of the yoke 1 are also partially embraced in a manner such that the supporting body 7 assumes a fixed position with respect to the yoke 1. For the sake of clarity, the section of the supporting body 7 situated between the legs 3, 4 of the yoke 1 is illustrated in cross section.

Attached to the end of the armature 6 facing away from the permanent magnet 5 is a head 10 having a stop 11, between which stop 11 and the leg 2 of the yoke a compression spring 12 is fitted which exerts a force on the armature 6 or the head 10 thereof in the direction away from the permanent magnet 5.

Between the legs 3 and 4 of the yoke 1, a first magnet winding 13 is mounted around the armature 6. For the sake of clarity, said magnet winding 13 is indicated diagrammatically with dash-dot lines. Arranged between the legs 2, 3 of the yoke 1 is a further magnet winding 14 around the armature 6, which magnet winding 14 is reproduced partially in cross section. For the sake of clarity. The connecting ends of the two magnet windings 13, 14 are not shown.

The armature 6, the permanent magnet 5 and the legs 3, 4 of the yoke 1 form a first magnetic circuit, the armature 6 assuming a first position as shown in the figure under the influence of the magnetic field of the permanent magnet 5.

In this trip device, which is based on the so-called active principle, the armature can be moved to its second position in which the head 10 projects further outwards by energizing one or both magnet windings 13, 14 with an electric current. The magnetic field of the permanent magnet 5 in the armature 6 can be attenuated with the magnet winding 13, while a magnetic force action can be brought about between the armature 6 and the leg 2 of the yoke 1 by the magnet winding 14. If the respective currents in the magnet windings 13 and 14 reach a level such that the force acting on the armature, inter alia, under the influence of the compression spring 12 is greater in the direction away from the permanent magnet 5 than the force exerted on the armature by the permanent magnet 5 itself, the armature will assume the said second position. This movement of the armature can be used to actuate the switching mechanism of an electrical switch of which the trip device may form part.

In the embodiment shown in FIG. 1, a bimetallic element 15 acting on the armature 6, or the stop 11, is further shown. With the aid of said bimetallic element 15 an additional force can be exerted on the head 10 in order to cause the armature 6 to move to the second position.

A shunt plate 16 is arranged between the permanent magnet 5 and the armature 6 in the embodiment shown. The shunt plate 16, which is supported by the supporting body 7, extends parallel to the leg 4 of the yoke 1 and transversely to the base side or leg 17 of the yoke 1. The permanent magnet 5, the shunt plate 16, the base side 17 and the leg 4 of the yoke 1 form a second magnetic circuit which is shunted with the first magnetic circuit of which the armature 6 forms part. By varying the distance of the shunt plate 16 from the base side 17 of the yoke 1, it is possible for the strength of the magnetic field of the permanent magnet in the armature 6 to be influenced. If a greater portion of the magnetic field of the permanent magnet 5 is shunted, a smaller current through one or both magnet windings 13, 14 will be capable of sufficing to cause the armature to move towards the second position and vice versa. Consequently, the threshold value above which the armature 6 can be moved towards the second position can be set by means of the shunt plate 16.

Figure 2:
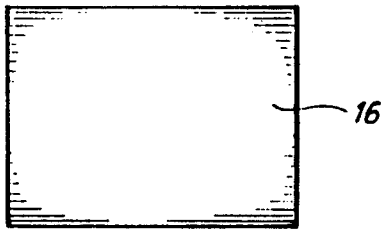
Fig-2 (Prior Art)
FIG. 2 shows diagrammatically in elevation the shunt plate used in the trip device according to FIG. 1.

As shown in FIG. 2, the shunt plate 16 is formed as a rectangular plate of magnetizable material in the trip device according to FIG. 1. It has been found, however, that this rectangular shape causes undesirable leakage fields, in particular as regards those sections of the shunt plate 16 which extend outside the pole face of the permanent magnet 5. In FIG. 1, a portion of the leakage field occurring as a consequence of the shunt plate 16 is indicated by arrows 18. In turn, said leakage field has per se a disadvantageous effect on the accuracy of the set threshold value, inter alia, because the strength of the type of leakage fields is difficult to calculate. As a result an accurate correction is equally impossible.

Figure 3:
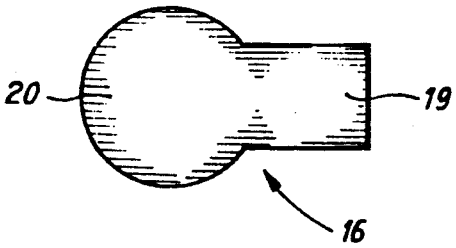
FIG. 3 shows diagrammatically in elevation an embodiment of the shunt plate according to FIG. 2 improved according to the present invention.

FIG. 3 shows an improved embodiment of the shunt plate 16 according to the invention in which the magnetically effective surface area of the shunt plate in the vicinity of the section 19 thereof which interacts with the yoke is smaller than the section 20 which is situated opposite a pole face of the permanent magnet 5. The surface area of the section 20 is in this case matched to the surface area of the respective pole face of the permanent magnet in a manner such that the section 20 extends as far as possible inside the circumferential boundary of the respective pole face. The contribution of the section 20 to the leakage flux is negligibly small as a consequence of this measure, while the contribution of the section 19, as a consequence of the reduced surface area thereof, will also be smaller than if a rectangular shunt plate according to FIG. 2 is used.

As has already been described in the introduction, the reduction of the magnetically active properties of the shunt plate has, inter alia, the advantage that demagnetization of the permanent magnet is effectively prevented. It is obvious that, as shown, for example, in FIG. 1, the yoke can also be suitably dimensioned for this purpose. The magnetic field strength as a consequence of the magnet winding 14 will be limited to the magnetic circuit formed by the legs 2 and 3 and the armature 6. The permanent magnet 5 is not influenced thereby or influenced to a negligibly small extent.

The embodiment shown is based on a cylindrical permanent magnet having a disc-shaped pole face. Other geometrical shapes are, of course, possible.

Figure 4:
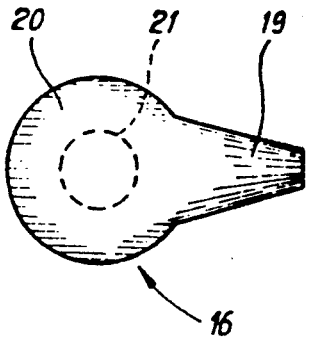
FIG. 4 shows diagrammatically in elevation the preferred embodiment of the shunt plate according to the invention.

It has been found that, on the one hand, a desirable shunting action and, on the other hand, as small a magnetic leakage field as possible can be achieved with a preferred embodiment of the shunt plate as shown in FIG. 4. The dimensions of the section 20 thereof are matched to the pole face of the permanent magnet 5, while the section 19, which interacts with the yoke 1, is of symmetrically tapered and converging shape starting from the section 20. For use in, for example, the trip device according to U.S. Pat. No. 3,693,122, the shunt plate may also be provided with two parts 19 extending opposite each other starting from the section 20. With a magnetically effective surface of the section 19 amounting to approximately 20 to 50% of the magnetically effective surface of the section 20 of the shunt plate 16, an optimum situation can be achieved as regards shunting action and low leakage flux.

The broken circle line 21 in FIG. 4 shows a convex elevation or bulge in the surface of the shunt plate situated opposite the armature. The radius of the convex elevation or bulge 21 in the shunt plate 16 is greater than the diameter of the armature 6. This measure achieves the result that even any misalignment of the armature 6 has a negligible disadvantageous effect on the set threshold value for causing the armature 6 to move towards the second position. The armature itself may be flat at its end 22.

Figure 5:
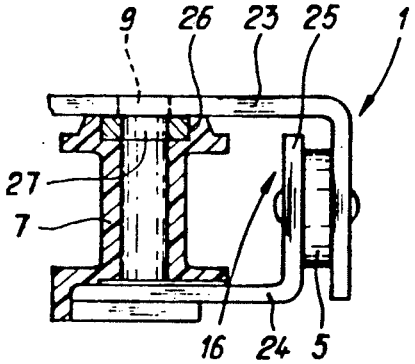
FIG. 5 shows diagrammatically, partially in cross section, a part of an embodiment of the trip device according to the invention.

FIG. 5 shows, partially in cross section, a further embodiment of a trip device according to the invention in which the armature and the magnet winding have been omitted for clarity.

In this case the yoke 1 is constructed of two L-shaped legs 23, 24 which have been joined to form a U-shaped yoke 1 with the insertion of the permanent magnet 5. In this embodiment, the shunt plate 16 is formed by the end 25 of the leg 24, which extends opposite a pole face of the permanent magnet 5 and transversely to the leg 23. The shape of the end 25 of the leg 24 corresponds to the shunt plate 16 as shown in FIG. 4.

Because the shunt plate forms a rigid component of the yoke, it is important in this embodiment of the trip device that no unintentional additional magnetic resistance is introduced into the magnetic circuit as a consequence of tolerances and assembly faults in the form of, for example, air gaps, because the permanently set threshold value is unintentionally influenced thereby. In particular, a precise dimensioning of the passage opening 9 for the armature 6 in the leg 23 of the yoke is necessary, which passage opening is matched to the thickness of the armature 6. As will be understood, this also applies to the embodiment as shown in FIG. 1.

Accordingly, the invention furthermore provides a bush 26 of magnetizable material which is fitted between the leg 23 at the position of the passage opening 9 and the end of the supporting body 7 connecting thereto. The bush 26 has a passage opening 27 accurately matched to the thickness of the armature. The bush furthermore abuts the leg 23.

The bush 26 achieves a good magnetic junction between the armature and the leg 23 at the position of the passage opening 9. As a result, said passage opening can be more amply dimensioned than the thickness of the armature, which offers both production engineering and cost engineering advantages, in particular, in yokes of laminated structure.

Figure 6:
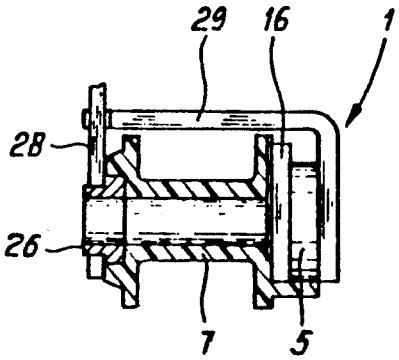
FIG. 6 shows diagrammatically, partially in cross section, a part of yet a further embodiment of the trip device according to the invention.

To take up tolerances in the mutual spacing of the legs 23, 24 and the dimensions of the supporting body 7 which can give rise to undesirable air gaps between the bush 26 and the leg 23, a still further embodiment of a trip device according to the invention is shown in FIG. 6, partially in cross section. The armature and the magnet winding again having been omitted for the sake of clarity.

In this embodiment, the yoke 1 is constructed of a straight leg 28 and an L-shaped leg 29, the bush 26 extends into the passage opening 9 for the armature 6 in the leg 28 and, if necessary, outside it.

In addition to a production engineering improvement, this embodiment furthermore has the advantage that any magnetic leakage fields between the armature and the leg 28 in the passage opening 9 are effectively reduced.

It is also possible to construct the leg 28, as shown in FIG. 6, as a separate element to be attached to the yoke, which facilitates the assembly of the trip device and with which the occurrence of an air gap between the bush 26 and the respective leg of the yoke can also be suppressed. The leg 23 in FIG. 5 may, of course, also be constructed to be detachable with the same advantage.

By manufacturing the bush of magnetizable material with suitably chosen magnetizable properties, the magnetic field in the first magnetic circuit can be influenced in a controlled way so that a very accurate setting of the threshold value also becomes possible with the bush 26.

Figure 7:
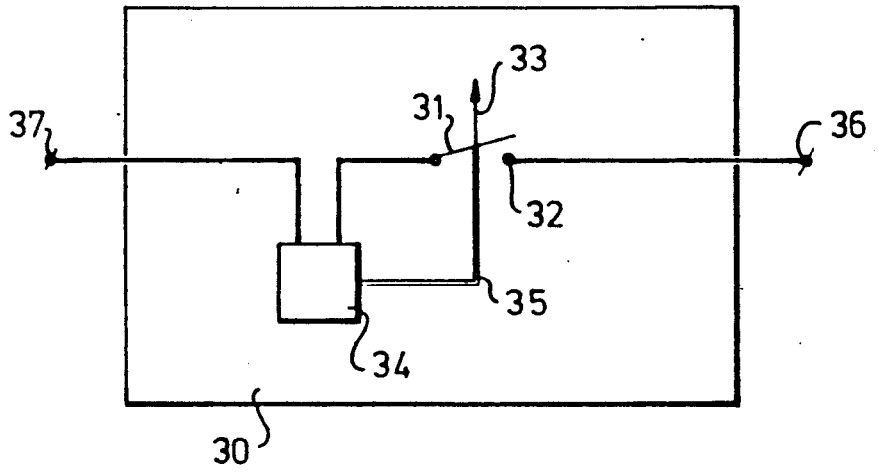
FIG. 7 shows a block diagram of an electric switch according to an embodiment of the present invention.

FIG. 7 shows schematically, in block diagram form, an embodiment of a switch according to the present invention. The switch has a housing 30, a contact pair comprising a movable contact 31 and a fixed contact 32, and spring means indicated by arrow 33 engaging the movable contact 31 of the contact pair. Also provided is a trip device 34 according to the present invention and actuating means 35, engaging the armature of the trip device for moving the movable contact 31, under the influence of the action of the spring means 33, in response to an action of the trip device.

The fixed contact 32 is electrically connected to a terminal 36 of the switch. At least one coil of the trip device is electrically connected in series with the movable contact 31 to a terminal 37 of the switch for electromagnetically moving the armature of the trip device under the influence of a current flowing through the contact pair 31, 32.

In the embodiment shown, the spring means 33 operates to bring the contact pair 31, 32 into the open state. However, it should be obvious for a person skilled in the art to modify the spring means to close the contact pair.

It will be clear that the measures described above and based on the inventive idea are not limited to application in trip devices as shown.

We claim:

1. A trip device for an electric switch, comprising a yoke of magnetizable material, a permanent magnet immovably positioned with respect to the yoke and a movably supported armature of magnetizable material, mutually arranged in a manner such that the armature, the permanent magnet and the yoke form a first magnetic circuit, the armature being able to assume a first position under the influence of the magnetic field of the permanent magnet, further comprising at least one magnet winding and spring means for causing the armature to assume a second position in response to the magnetic field generated by an electric current, flowing during operation in the at least one magnet winding, if a pre-set threshold value is exceeded, a second magnetic circuit being provided for adjusting the threshold value in the form of shunt means of magnetizable material interacting with the yoke and the permanent magnet in order to influence the magnetic field in the first magnetic circuit by shunting, wherein the portion of the shunt means interacting magnetically with the yoke is effectively smaller than the portion of the shunt means interacting magnetically with the permanent magnet.

2. A trip device comprising a yoke of magnetizable material, a permanent magnet immovably positioned with respect to the yoke and a movably supported armature of magnetizable material, mutually arranged in a manner such that the armature, the permanent magnet and the yoke form a first magnetic circuit, the armature being able to assume a first position under the influence of the magnetic field of the permanent magnet, further comprising at least one magnet winding and spring means for causing the armature to assume a second position in response to the magnetic field generated by an electric current, flowing during operation in the at least one magnet winding, if a pre-set threshold value is exceeded, a second magnetic circuit being provided for adjusting the threshold value in the form of shunt means of magnetizable material interacting with the yoke and the permanent magnet in order to influence the magnetic field in the first magnetic circuit by shunting, wherein the magnetically effective surface area of the shunt means is effectively smaller in the vicinity of the section thereof which interacts with the yoke than in the vicinity of the section which interacts with the permanent magnet, wherein the yoke comprises at least two legs at an angle to each other, the permanent magnet being situated in the vicinity of the free end of one leg thereof, the shunt means having essentially the form of a flat shunt plate, the section of the shunt plate interacting with the permanent magnet being positioned with its one surface partially opposite a pole face of the permanent magnet and with its other surface partially opposite the armature, the section of the shunt plate interacting with the yoke being arranged at a distance from, and at an angle to, a further leg of the yoke, the shunt plate being dimensioned such that the section situated opposite the pole face of the permanent magnet extends as far as possible inside the circumferential boundary of the respective pole face, whereas the section of the shunt plate interacting with the yoke extending in the direction of the said further leg having a shape which decreases in surface area in the direction of the respective leg.

3. A trip device according to claim 2, wherein the section of the shunt plate extending in the direction of the said further leg of the yoke is of symmetrically tapered and converging shape starting from the one section bounded by the pole face of the permanent magnet.

4. A trip device according to claim 2, wherein said pole face of the permanent magnet is disc-shaped, the section of the shunt plate situated opposite the respective pole face having a disc-shaped surface, the diameter of which is equal to or less than the diameter of the respective pole face.

5. A trip device according to claim 2, wherein the surface area of the section of the shunt plate extending in the direction of the said further leg of the yoke is less than half the surface area of the section of the shunt plate situated opposite the respective pole face of the permanent magnet.

6. A trip device according to claim 2, wherein the shunt plate forms part of a leg of the yoke.

7. A trip device according to claim 2, wherein the armature is of elongated shape and is situated with one end opposite the said other surface of the section of the shunt plate situated opposite the respective pole face of the permanent magnet a convex elevation having a larger radius compared with the diameter of the armature is provided in the said other surface of the shunt plate at the position where the armature encounters the shunt plate.

8. A trip device according claim 2, wherein the armature is of elongated shape and the yoke comprises at least two legs situated as far as possible in parallel and at a distance from each other, between which legs a tubular supporting body extends in order to movably support the armature, at least one of the legs being provided with a passage opening through which the armature can be moved, a bushing of magnetizable material being mounted between the respective leg at the position of the passage opening and the end of the supporting body connecting thereto.

9. A trip device according to claim 8, wherein the bushing extends into the passage opening.

10. A trip device according to claim 9, wherein the respective leg with the passage opening is constructed as a separate element to be attached to the yoke.

11. A trip device according to claim 8, wherein the bushing is manufactured from magnetizable material having magnetizable properties differing from the material of the armature and the yoke.

12. An electric switch having a housing, at least one contact pair, a spring system and actuating means for bringing said at least one contact pair into one or another position under the influence of the action of the spring system, wherein the actuating means comprise a trip device having a yoke of magnetizable material, a permanent magnet immovably positioned with respect to the yoke and a movably supported armature of magnetizable material, mutually arranged in a manner such that the armature, the permanent magnet and the yoke form a first magnetic circuit, the armature being able to assume a first position under the influence of the magnetic field of the permanent magnet, further comprising at least one magnet winding and spring means for causing the armature to assume a second position in response to the magnetic field generated by an electric current, flowing during operation in the at least one magnet winding, if a pre-set threshold value is exceeded, a second magnetic circuit being provided for adjusting the threshold value in the form of shunt means of magnetizable material interacting with the yoke and the permanent magnet in order to influence the magnetic field in the first magnetic circuit by shunting, wherein the portion of the shunt means interacting magnetically with the yoke effectively smaller than the portion of the shunt means interacting magnetically with the permanent magnet.

13. An electric switch having a housing, at least one contact pair, and a spring system and actuating means for bringing said at least one contact pair into one or another position under the influence of the action of the spring system, wherein the actuating means comprise a trip device having a yoke of magnetizable material, a permanent magnet immovably positioned with respect to the yoke and a movably supported armature of magnetizable material, mutually arranged in a manner such that the armature, the permanent magnet and the yoke form a first magnetic circuit, the armature being able to assume a first position under the influence of the magnetic field of the permanent magnet, further comprising at least one magnet winding and spring means for causing the armature to assume a second position in response to the magnetic field generated by an electric current, flowing during operation in the at least one magnet winding, if a pre-set threshold value is exceeded, a second magnetic circuit being provided for adjusting the threshold value in the form of shunt means of magnetizable material interacting with the yoke and the permanent magnet in order to influence the magnetic field in the first magnetic circuit by shunting, wherein the magnetically effective surface area of the shunt means is effectively smaller in the vicinity of the section thereof which interacts with the yoke than in the vicinity of the section which interacts with the permanent magnet wherein the yoke comprises at least two legs at an angle to each other, the permanent magnet being situated in the vicinity of the free end of one leg thereof, the shunt means having essentially the form of a flat shunt plate, the section of the shunt plate interacting with the permanent magnet being positioned with its one surface partially opposite a pole face of the permanent magnet and with its other surface partially opposite the armature, the section of the shunt plate interacting with the yoke being arranged at a distance from, and at an angle to, a further leg of the yoke, the shunt plate being dimensioned such that the section situated opposite the pole face of the permanent magnet extends as far as possible inside the circumferential boundary of the respective pole face, whereas the section of the shunt plate interacting with the yoke extending in the direction of the said further leg having a shape which decreases in surface area in the direction of the respective leg.

* * * * *